US005267880A

United States Patent [19]

Tamm

[11] Patent Number: 5,267,880

[45] Date of Patent: Dec. 7, 1993

[54] WATERPROOF FUSIBLE BREAKAWAY ELECTRICAL CONNECTOR

[75] Inventor: Carl R. Tamm, Jonesborough, Tenn.

[73] Assignee: Buchanan Construction Products, Inc., Hackettstown, N.J.

[21] Appl. No.: 962,747

[22] Filed: Oct. 19, 1992

[51] Int. Cl.[5] ..... H01R 13/68

[52] U.S. Cl. ..... 439/622

[58] Field of Search ..... 439/620, 621, 622, 698, 439/274, 275; 337/188, 189, 205

[56] References Cited

U.S. PATENT DOCUMENTS

| | | | |
|---|---|---|---|
| 946,251 | 1/1910 | Moffitt et al. | 439/698 |
| 2,668,888 | 2/1954 | JOhnson | 439/622 |
| 3,145,329 | 8/1964 | Deakin et al. | 439/620 |
| 4,214,806 | 7/1980 | Kraft | 439/620 |
| 4,568,137 | 2/1986 | Leuthold | 439/622 |
| 4,968,264 | 11/1990 | Ruehl et al. | 439/620 |
| 5,038,050 | 8/1991 | Minoura | 439/621 |
| 5,145,415 | 9/1992 | Doudon | 439/621 |

*Primary Examiner*—P. W. Echols
*Attorney, Agent, or Firm*—Kinzer, Plyer, Dorn, McEachran & Jambor

[57] ABSTRACT

A connector assembly for electrically connecting or splicing multiple pairs of insulated conductors comprising a feeder circuit, and providing a tap connection through an integral and easily accessible fuse for each phase of the circuit. The assembly comprises a multipiece housing typically of thermoplastic material, and includes various caps and plugs which when assembled provide a watertight seal for the entire connection. The tap connection, commonly referred to as the load side, comprises a male plug assembly consisting of two blades within a housing which in turn is seated within an elastomeric boot; this entire assembly is mated with a female receptacle on the main housing, coming into intimate contact with the female receptacle, insuring a submersible watertight seal. This tap connection can be readily disconnected and re-connected without interruption to the main feed circuit, by simply unplugging the load side plug from the line side housing. This unplugging occurs readily if undue tensile stress is applied to the load side conductors thereby serving as an emergency "breakaway" disconnect feature. The fuses are situated such that they are readily accessible for inspection or replacement without interruption to the main feed circuit, or disconnection of the tap or load side.

18 Claims, 6 Drawing Sheets

Fig. 5.
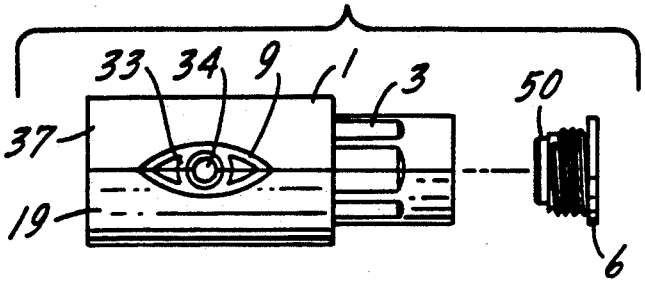
Fig. 5A.
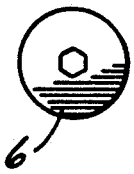
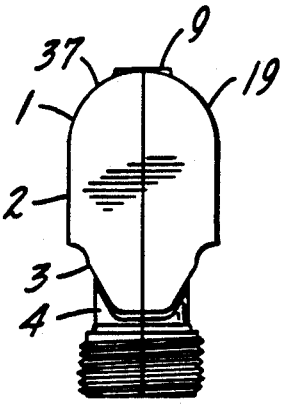
Fig. 6.
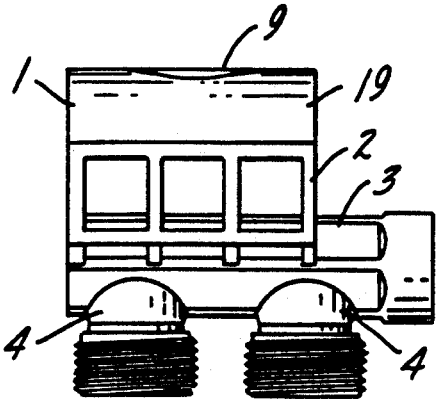
Fig. 7.
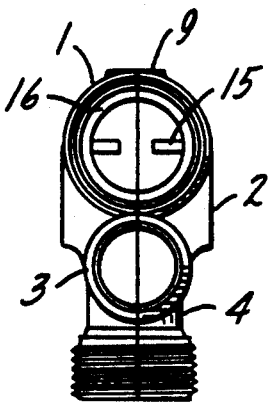
Fig. 8.
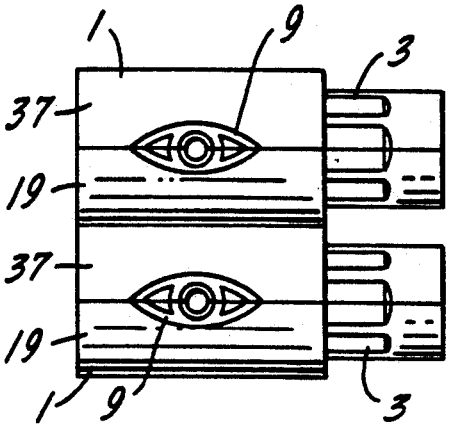
Fig. 9.

WATERPROOF FUSIBLE BREAKAWAY ELECTRICAL CONNECTOR

THE FIELD OF THE INVENTION

This invention pertains to electrical connectors and fuse holders, and more particularly to the field of waterproof "breakaway" connectors used most commonly for roadway lighting circuit connections providing means to complete the feeder circuit, and a fusible and breakaway tap connection for the luminaire.

It is common practice in roadway lighting to make use of hollow metal or fiberglass poles to support luminaires above the roadway. To minimize injury in the event of a vehicle colliding with a pole, the pole is provided with a breakaway feature at the base. For purposes of safety, feeder circuits are commonly installed underground, the individual conductors surfacing within the confines of the pole base for protection from accidental abrasion, vandalism, and for the purposes of practical safeguarding in regard to electrocution of humans or animals. Connections are made within the base of the pole to complete the feeder circuit to the remaining poles and to provide a tap connection to energize the luminaire. In the event of an impact, the pole is sheared off at the base and commonly comes to rest several yards from its original position. As is evident, the electrical circuit within the pole must be provided with means of disconnect which will allow the load side or tap connection to separate from the line side by means of suitable tension applied to the load side conductors in the event a pole knockdown were to occur due to impact from a vehicle, thus preventing the feeder circuit being unearthed or broken; disrupting power to the rest of the circuit, which would be very important in the event of a nighttime accident; leaving broken or frayed electrical conductors exposed providing potential for electrocution to persons in the accident site; and energized electrical wires falling into traffic or the accident vehicle(s). In addition to these features, it is necessary that a fuse be provided for protection of the load circuit, and in the event of a problem in the load circuit, the fuse would open, leaving the remainder of the lighting circuit energized.

Of particular importance, since this type of connector must be accessible for maintenance, is that the fuse be installed in such a manner that maintenance personnel are at no risk of electrical shock during fuse inspection or replacement. A further requirement for this application is that the connector be watertight, as certain conditions could occur, causing the connector to be submersed in flood water.

A variety of problems exist with the present devices for the use described, the most significant of which is safety for the maintenance personnel, as often incidents occur with each type of device known which expose the maintenance electrician to possible electrical shock because the fuse may be accessed while still connected to a live power supply. This is due to the inherent design of present known products having the fuse axially aligned with the apparent direction of the tap cables (hence the common term "in-line fuse holder"). The earliest forms of connectors designed specifically for this application were single pole devices, meaning they only connected one phase or leg of the load circuit. As these circuits require at minimum two conductors in the circuit, i.e. phase and neutral or phase and phase, it is apparent that two such connectors be supplied at each pole. In this situation it is difficult to disconnect both connectors simultaneously, therefore when one connector is disconnected the male portion is exposed and typically dangerous until the other leg can be disconnected as current could pass through the still connected leg, through the luminaire, and through the exposed male contact. To eliminate this problem, it was later recognized that bipolar connectors would greatly enhance the safety factor, insuring simultaneous disconnect of both legs of the load circuit. Still, with the fuses being axially aligned with the cables and the cables being vertical, traversing the interior of the erected pole, the fuse, due to the effect of gravity would tend to remain nested in the energized line side as it is positioned on the lower end. Various means for retaining the fuse on the load side have been used, typically by providing an interference fit at the load end of the fuse with springs or elastomeric collars. All of these devices have been known to fail in their respective capacity, thereby allowing the fuse to remain nested in the line side an thus potentially hazardous to the maintenance personnel. This problem is eliminated by the present invention as will be later explained.

Another common problem is that of water. Many times these connectors are located in areas which may be flooded occasionally. The present known methods all incorporate rubber boots for the purpose of providing a waterproof seal. These boots are elongated tapered tubes made of rubber or other elastomeric compounds which are required to be cut off to a prescribed length to accommodate various wire diameters with instructions accompanying the connector as to how large to cut the boot for particular size wire, the objective being to insure a suitable interference fit of the insulated conductor within the boot. Due to various wire insulation types having different thickness, it becomes difficult to identify wire by trade size in order to provide instruction as to where to cut the tapered boot to effect a particular interference fit; therefore, these instructions usually refer to total wire diameter, which is usually difficult for an electrician to measure as vernier calipers and micrometers are not typical tools which electrical installation technicians commonly carry. In addition to this, even if the boot is cut off at the correct size it is often very difficult to force the conductor into the small end of the boot as there is no means to guide the boot over the wire, as the taper is in the opposite direction to facilitate this action (like trying to pour liquid through an inverted funnel). To overcome this problem, many times the installer will cut the boot too short, effecting a larger aperture through which he may more easily pass the conductor. When these boots are cut off too short, their purpose is defeated, allowing moisture to gain access to the enclosed connector, thereby causing corrosion and safety problems. The boot of the present invention overcomes these problems.

A further problem exists with many of the products now available that, although not intentionally, they are sometimes installed backward as their design does not physically prevent this mistake. This effects an installation where the line or feeder circuit conductors are attached to the load side of the connector housing. In this situation, the fuse retaining means, designed to hold the fuse on the load side when disconnected, now holds the fuse on the energized line side creating an unsafe condition for the maintenance person. The unique design of the present invention anticipates this as well as other problems and provides a connector which addresses them.

SUMMARY OF THE INVENTION

It is a principal object of the present invention to provide a new and improved waterproof fusible breakaway connector comprising means to facilitate a "wye" or tap connection on two legs of an electrical circuit, providing continuity of both feed through connections for the main feed circuit, and a single plug device which will simultaneously disconnect both phases or legs of the load or tap side, effecting a greater degree of safety.

Another object of the present invention is to provide access to the fuses contained within in such fashion as it is impossible to receive electrical shock due to live components being inadvertently exposed either on purpose or accidentally.

Still another object of the present invention is to provide suitable means to insure a watertight connection which does not require cutting or sizing of the elastomeric seals, thereby insuring the integrity of a watertight installation which is not inadvertently defeated by improper or negligent installation procedures.

Still another object of the invention is to provide a connector which is by design impossible to install backwards so that objectionable situations, such as live electrical parts being inadvertently exposed, cannot occur.

Still another object of the invention is to provide a connector which includes all of the above features in a compact design such that it is easily fitted through a 2×5 inch hand hole which is common on some roadway lighting poles.

Other objects will appear in the ensuing specification, drawings and claims.

BRIEF DESCRIPTION OF THE DRAWINGS

FIG. 5 is a top view of one section, two body halves assembled, with top and front view of the bus plug on the right;

FIG. 5A is an end view of the buss plug.

FIG. 6 is a rear view of one section;

FIG. 7 is a left-side view of the invention;

FIG. 8 is a front view of one section;

FIG. 9 is a top view of two sections joined, forming a unit, without the female receptacle attached;

DESCRIPTION OF THE PREFERRED EMBODIMENT

A primary feature of the invention resides in the provision of one device securing all the connections required in a pole base for both legs of the feeder or line side circuit, as well as both conductors of the tap, or load side circuit. Included in this device is a single bipolar plug assembly which serves to disconnect both legs of the load circuit simultaneously, insuring an effective "breakaway" feature, the plug assembly being housed within a unique boot, providing ease of installation of the conductors, and designed to accommodate the necessary range of cable sizes without any alteration.

Another specific feature included in this connector arrangement is a fuse for each energized phase, providing over current protection to the load circuit, as well as fault protection to the line circuit. Said fuse(s) being arranged typically perpendicular to the apparent axis of the conductors. As will be explained hereinafter, this enables the fuses to be accessed without exposure to energized components of the circuit.

Still another specific feature of the present invention is to provide means for insuring waterproof seals for the line side conductors by use of elastomeric bushings within tapered packing glands not requiring, and thus preventing any field alteration which may defeat the waterproof integrity of the device. Having four of these devices located on the bottom, as there will be four conductors connected for the line side, and only two, which must disconnect on the load side, it will be understood from the detailed description which follows, that the device of the present invention cannot be installed in reverse manner.

It will be appreciated that by virtue of the unique design of this device, and the arrangement of the fuses, the physical size requirements to accommodate this array of connections can be comfortably sized to fit through a 2×5 inch hand hole, which becomes a limiting factor on many streetlight poles of present design.

Figure 16:
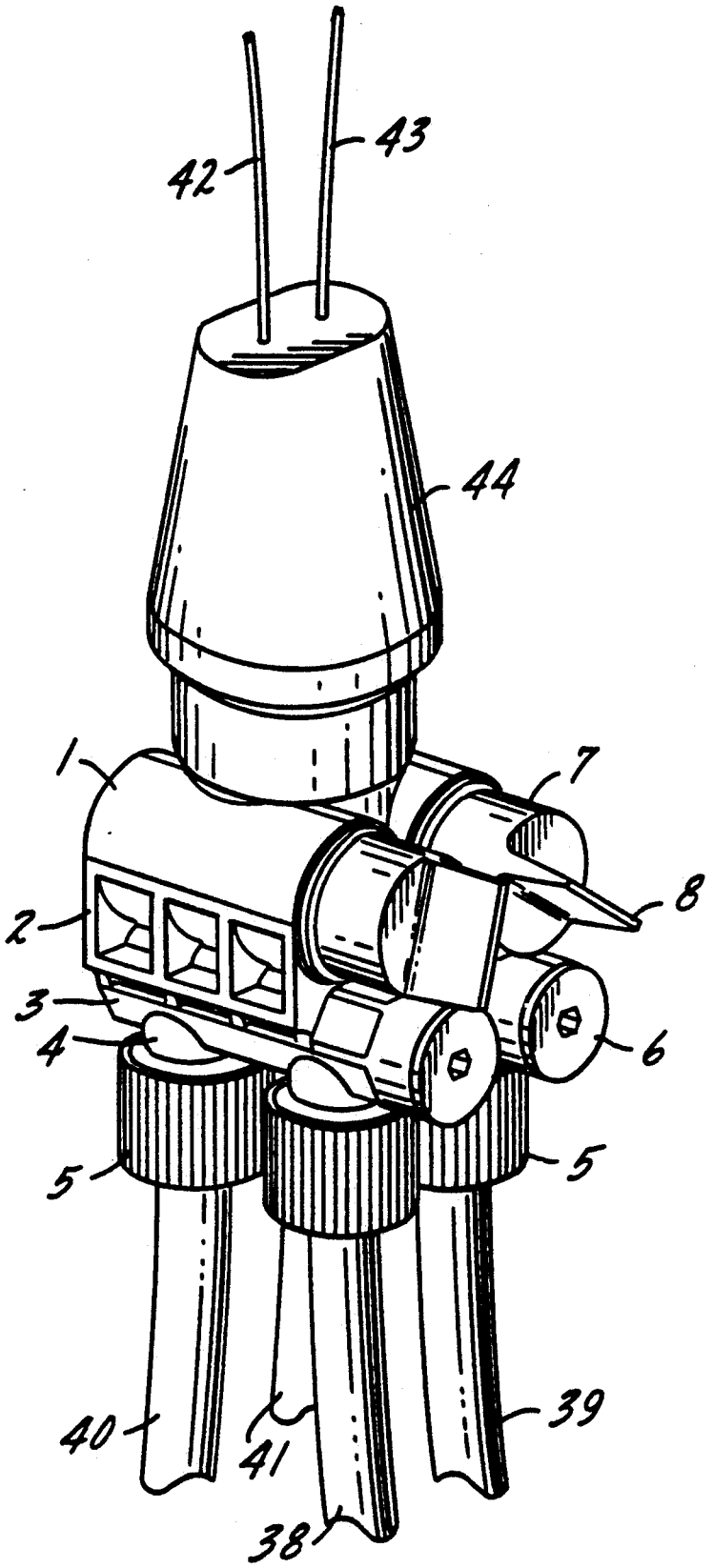
FIG. 16 is a complete double "Y" connector assembled and installed.

Turning now to the drawings, the present invention represented substantially in its entirety in a typical installation in FIG. 16, is intended to provide electrical continuity with sufficient amperage capacity between electrical cables 38 and 40 (phase "A"), and between cables 39 and 41 (phase "B"). These cables represent the line feeds for the circuit, typifying two separate phases ("A" and "B"), or a single phase and neutral conductor feeding into the connector, cables 38 and 39, respectively; and feeding out from the connector, continuing the circuit to the next connector, cables 40 and 41, respectively.

Figure 15:
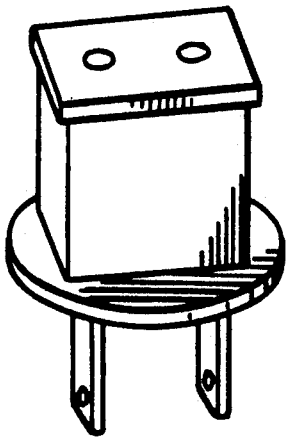
FIG. 15 is a perspective view of the bipolar plug.

Electrical continuity is carried internally through fuses located inside fuse retaining caps 7 and to a female receptacle located in the upper portion of the device 24. A double contact male plug (represented in FIG. 15, similar in configuration to a typical 110 volt AC lamp plug) housed within the elastomeric boot 44 is engaged with the receptacle, thus providing fuse protected output of phase "A" through wire 42 and phase "B" through wire 43 which continue to the load (or luminaire in the case of a streetlight).

Figure 1:
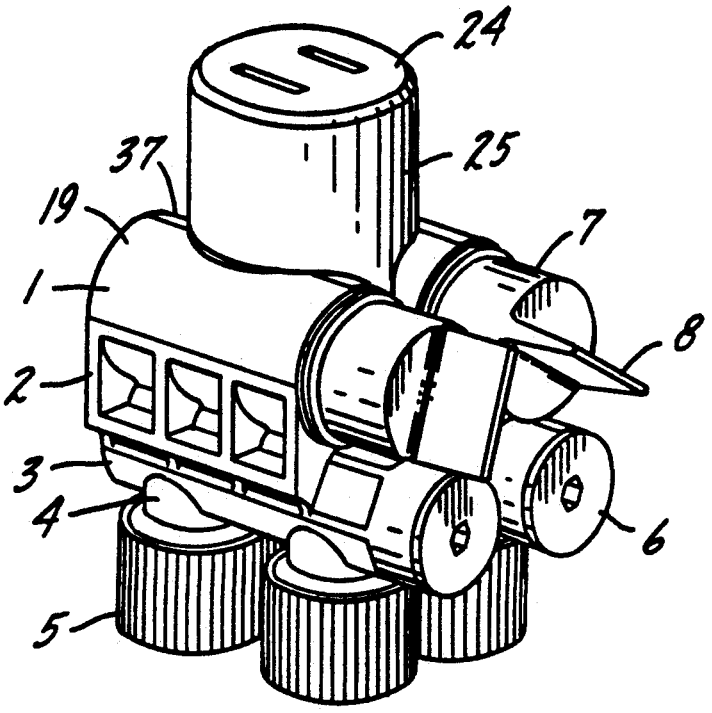
FIG. 1 is a perspective view of the invention providing a double "Y" connection configuration.

FIG. 1 shows the preferred embodiment of the present invention revealing the typical two-blade female receptacle 24, typical in nature to a common household 110 volt AC receptacle, polarized by having one blade larger than the other, thereby preventing reversed insertion of the mating male plug, similarly polarized. As this device may be used on a variety of voltage or phase configurations, this receptacle will for standards of safety be of differing dimensions than those of the common 110 volt AC receptacle. The receptacle is mounted within a cylindrical housing 25, which is itself mounted to the top of a dual assembly (complete unit) represented in FIG. 9, in such fashion as to provide hermetic seals between itself and mounting surfaces 9 and 34 represented in FIG. 5.

Figure 2:
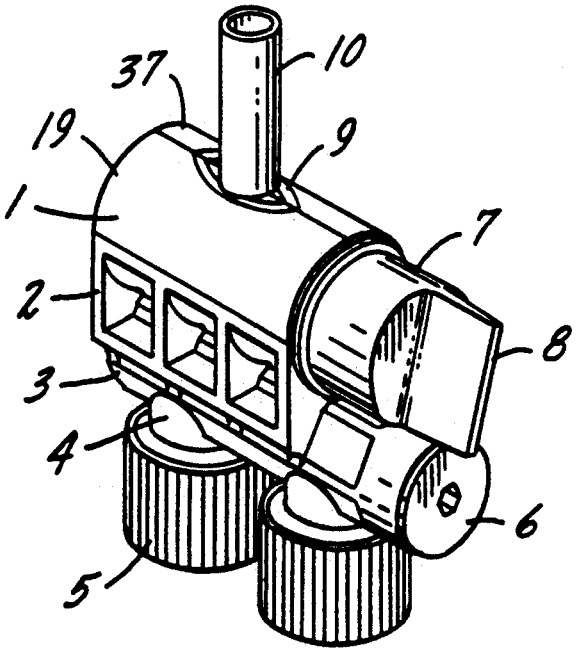
FIG. 2 is a perspective view of the invention providing a single "Y" connection configuration.

FIG. 2 represents an alternate method of providing the invention assembled to provide a single "Y" connection. There is only a single section, thus servicing only a single phase and having only a single output device 10 as opposed to the bipolar configuration represented in FIG. 1. This single output terminal consists of a slender cylindrical portion containing a single female sleeve contact suitable to receive and provide ample electrical continuity for a single male pin contact, which is typical of a variety of electrical connectors, and will be apparent to those skilled in the art. The outer portion being electrically insulating thermoplastic or similar material is attached to the mounting surface 34 shown in FIG. 5 in such fashion as to provide a hermetic seal at the joint.

Figure 3A:
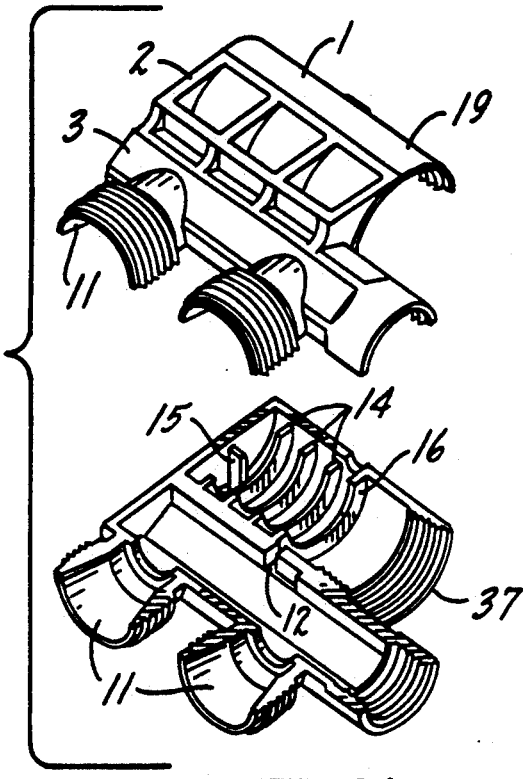
FIGS. 3A and 3B are perspective views showing the single body shell halves separated, prior to assembly, and oriented such that both the bottom portion and top portions may be viewed.
Figure 3B:
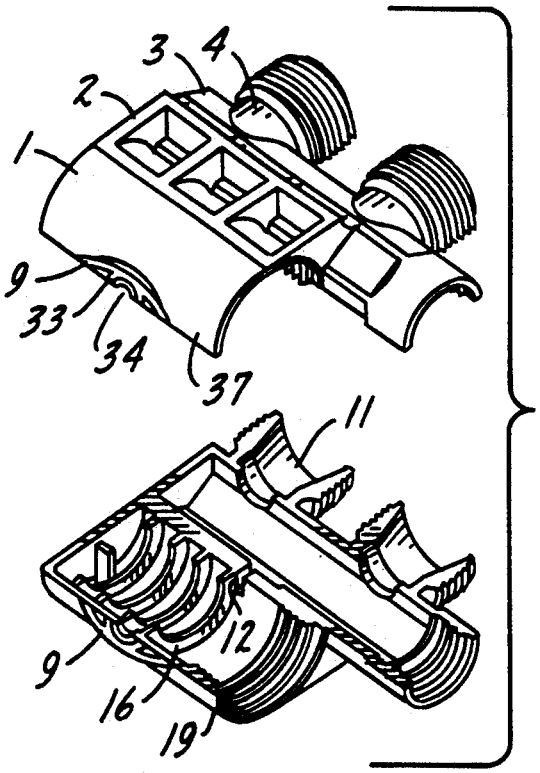

FIGS. 3A and 3B represent two views of the exterior shell halves, 19 and 37, prior to assembly. These shells provide the structural rigidity of the device and are preferably made of a thermoplastic material, although other materials may be suitable which provide the electrical insulating properties as well as the structural properties required. One shell 19 (the left half) is typically a mirror image of its mating half 37 (the right half), with the exception of the threaded sections which must, of necessity, match accordingly, as well as provisions for assembly such as a male tongue on one half, and a female groove on the opposed or mating surface, or pin and socket or similar means for alignment of the mating halves.

Figure 4A:
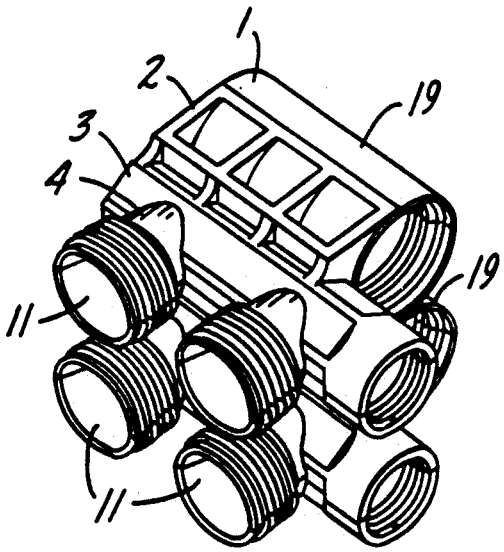
FIGS. 4A and 4B are perspective views showing two entire sections assembled to form one unit, from both the bottom and top views; (A section is one set of body shell halves; whereas, a unit is two sections joined.)
Figure 4B:
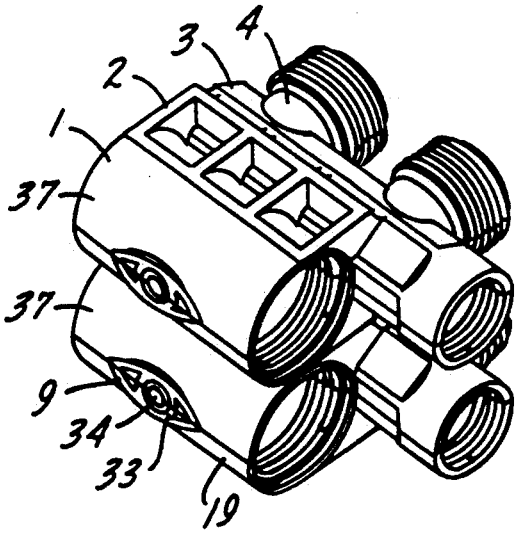

The fuse section 1 of the body shell is typically cylindrical and is faced on the outside by a structure of rectangularly arranged ribs 2 which serve not only to provide structural integrity to the design, but also as mating surfaces by which to join two sections as shown in FIG. 4 prior to attachment of the receptacle housing 25 represented in FIG. 1. The outer surfaces of the ribs 2 may also contain alignment means such as pin and socket, or tongue and groove, respectively.

This rib section 2 is carried through into intimate contact with the electrical contact portion of the housing 3 which is shown in this representation to be hexagonal, although other shapes could be incorporated without departing from the scope of the invention. The purpose of this shape in the preferred embodiment is to house the tubular electrical bus 20 represented in FIG. 10 and 11 which is hexagonal along its exterior axis providing a snug fit within the intended section of the body, its shape lending to its resisting radial motion within the housing. Again, varying geometric shapes could be incorporated in both the housing section 3 and the tubular bus 20 without departing from the scope of the invention. Bosses and externally threaded portions 4 are provided which blend smoothly with the external surface 3 to serve as entry ports for the circuit feed conductors 38, 39, 40, and 41, the threads on these bosses 4 accepting the gland nuts.

Figure 10:
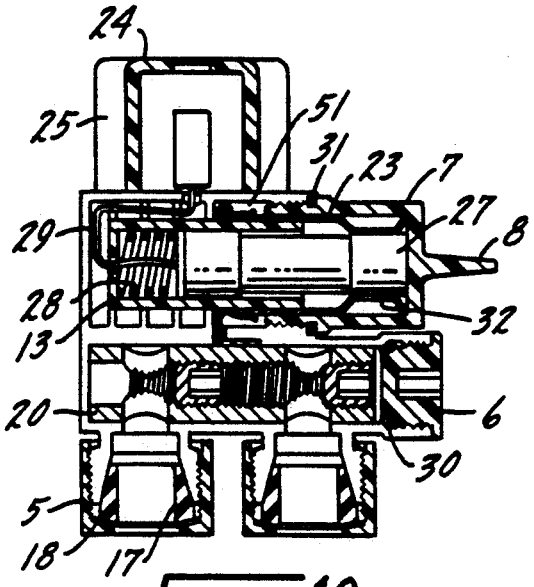
FIG. 10 is a cutaway sectional view of a complete assembled section with the cutting plane through the center.
Figure 11:
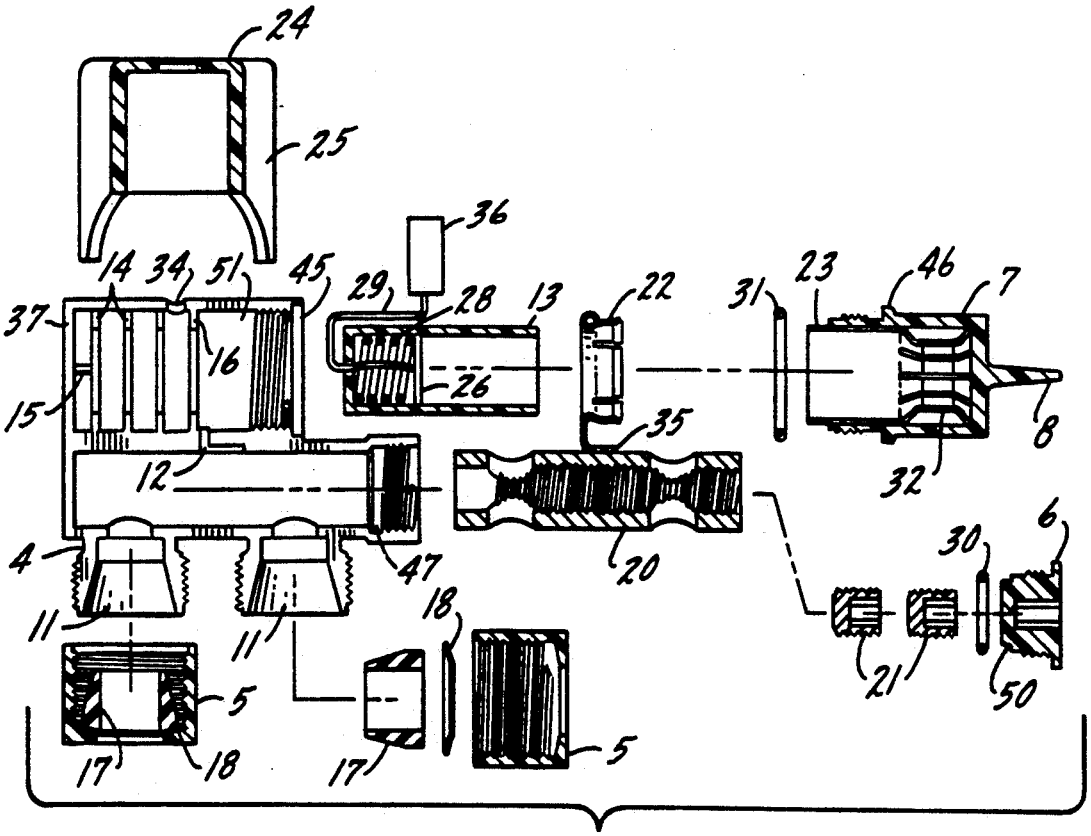
FIG. 11 is an exploded view of FIG. 10, more readily identifying the various components.
Figure 12:
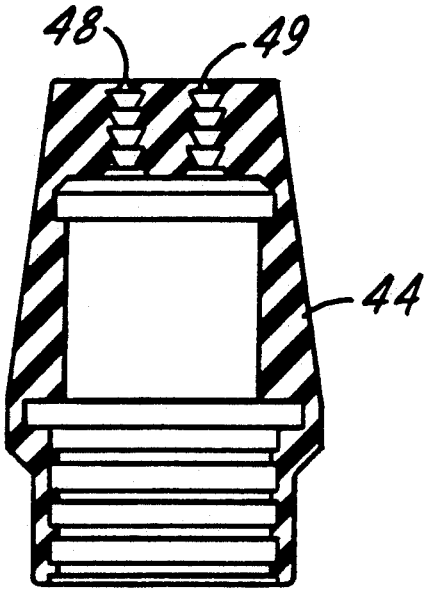
FIG. 12 is a cutaway of the elastomeric boot, from the front, with the cutting plane co-planar with both aperture axes.
Figure 13:
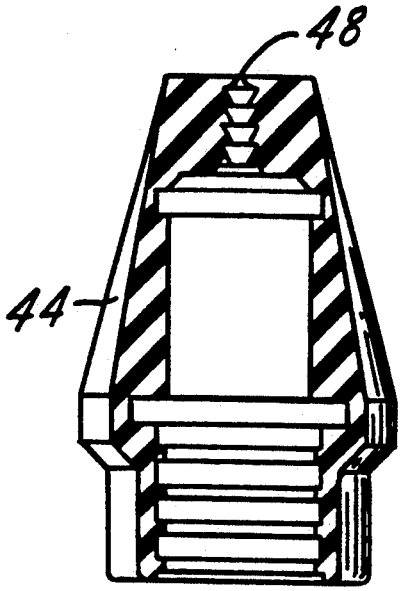
FIG. 13 is a cutaway of the elastomeric boot, from the side, with the cutting plane perpendicular with the plane of both axis apertures, and including the axis of the nearest aperture.
Figure 14:
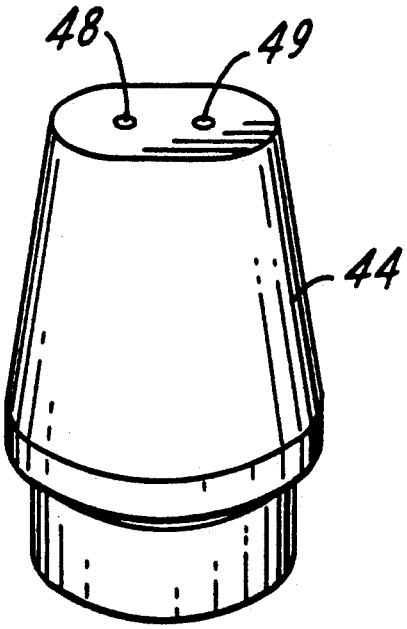
FIG. 14 is a perspective view of the elastomeric boot.

Referring to FIGS. 10 and 11, the various parts are identified as follows:

| | |
|---|---|
| 5 | Gland nut |
| 6 | Bus sealing plug |
| 7 | Fuse retaining cap |
| 8 | Fuse cap tang |
| 9 | Bipolar receptacle sealing boss |
| 10 | Single pole socket housing |
| 11 | Tapered packing gland |
| 12 | Slot for tap contact (tulip contact) |
| 13 | Fuse tube |
| 14 | Fuse tube support ribs |
| 15 | Fuse tube depth stop |
| 16 | Fuse tube sealing rib (innermost surface) |
| 17 | Elastomeric packing (bushing) |
| 18 | Washer |
| 19 | Left shell half |
| 20 | Hexagonal tubular line bus |
| 21 | Socket head setscrews |
| 22 | Tap contact (tulip contact) |
| 23 | Cylindrical basket fuse retaining contact |
| 24 | Bipolar receptacle |
| 25 | Bipolar receptable housing |
| 26 | Spring loaded (output) fuse contact |
| 27 | Fuse (typical cartridge fuse) |
| 28 | Spring |
| 29 | Fuse output cable |
| 30 | Bus sealing plug O-ring |
| 31 | Fuse retaining cap O-ring |
| 32 | Basket section of 23 |
| 33 | Sealing boss for 10 |
| 34 | Output cable port |
| 35 | Provision for electrical contact between 20 and 22 |
| 36 | Sliding spring contact to receive blade of male plug |
| 37 | Right shell half |
| 38 | Input cable, line side (phase "A") |
| 39 | Input cable, line side (phase "B") |
| 40 | Output cable, line side (phase "A") |
| 41 | Output cable, line side (phase "B") |
| 42 | Load side output (phase "A") |
| 43 | Load side output (phase "B") |
| 44 | Elastomeric boot (houses and waterproofs male bipolar plug assembly) |
| 45 | O-ring retaining counterbore |
| 46 | Fuse cap lip (annular rib) |
| 47 | O-ring seat (bus sealing plug aperture) |
| 48 | Aperture for (phase "A") load side output wire 42 |
| 49 | Aperture for (phase "B") load side output wire 43 |
| 50 | O-ring seat (bus sealing plug) |
| 51 | Annular section |

FIG. 5 is a top view of a single set of shell halves assembled, showing the mounting boss 9 for the bipolar receptacle housing 25 integral with the mounting boss 33 for the single pole socket housing 10, and the aperture 34 through which the fuse output cable 29 is conducted.

FIG. 8 reveals the typically hollow shell halves assembled to form one section, from the front view, revealing the fuse tube sealing rib 16 and the fuse tube depth stop 15, as viewed through the front openings without any caps or any other parts installed.

FIG. 9 reveals the configuration of the mounting bosses from the top of two assembled sections which construe a unit, the bipolar design of the preferred embodiment. As can be seen, the bosses 9 are configured in the complete assembly as to accept the cylindrical shaped bipolar receptacle housing 25.

The path of electrical conductivity through the device can best be illustrated using FIGS. 10 and 11. For simplicity only the left side (phase "A"), as is illustrated in FIGS. 10 and 11, will be described. The right side of the connector (phase "B") is identical.

The output cable, line side 40, is installed through the rear boss 4, first stripping the insulation from an appropriate length of the cable to insure electrical contact through the tubular line bus 20, then inserting the end of the cable through the gland nut 5, washer 18, and elastomeric packing 17, which are typically pre-assembled within the tapered packing gland 11, completely into the connector. The cable is then secured with a socket head setscrew 21 inside the hexagonal tubular line bus 20. Note that identification of cable 40 is (output), this is not necessary, but only used for identification purposes in this text. It is important however that the rearmost cable be installed first, as access to the setscrew which secures the rearmost cable is obstructed once the forward cable (38 in this text) is installed. After tightening the setscrew the gland nut is tightened, compressing the elastomeric packing into the tapered packing gland and around the insulation of the cable, thus insuring a watertight seal and enhancing the mechanical secureness of the cable within the connector.

Once the rear cable 40 is installed, the forward cable 38 is installed in the same fashion. This secures uninterrupted conductivity of the feed circuit.

The bus sealing plug 6 can then be installed into the open threaded end of the contact section. The O-ring 30, which is typically captive within a seat 47 at the rear of the threaded section, is compressed by a mating surface 50 on the bus plug, thereby providing a watertight seal.

Assembled to the top center of the tubular line bus 20 is the tap, or tulip contact, attached by welding or similar means at 35. The tulip contact 22 is of circular shape having forward projecting tangs which flare outward at or near their extremities. One tang on the bottom is formed downward and forward to contact the bus 20 as illustrated most clearly in FIG. 11. In its installed position, its internal circumference circumscribes the external circumference of the fuse tube 13. A cartridge fuse of the appropriate size 27 is then inserted into the basket portion 32 of the cylindrical fuse retaining contact 23, which is permanently secured within the fuse retaining cap 7. This assembly is then inserted with the fuse only passing into the fuse tube 13, the cylindrical contact portion 23, passing over the outside of the fuse tube, into the annular section 51. The fuse tube 13 is permanently nested within the confines of the fuse tube support ribs 14 and fuse tube sealing rib 16 to its complete depth against the fuse tube depth stop 15. Once the external threads of the fuse retaining cap engage with the internal threads of the embodiment, the end of the fuse will contact the fuse output contact 26, and as the fuse retaining cap is screwed toward its final position, the edge of the cylindrical fuse retaining contact 23 will engage with the tulip contact, thus providing a current path from the bus 20, through the fuse 27, along the fuse output cable 29 to the sliding spring contact 36 of the receptacle 24.

Several significant safety features are apparent at this point. The fuse, though readily accessible, can in no manner be touched when connected to live parts. This is accomplished by the unique configuration of the invention, having the fuse aligned perpendicular to the apparent axis of the tap output wire, as opposed to being "In-Line" such as is typical of present known products. As the fuse retaining cap is unscrewed, contact between the tulip connector 22 and the cylindrical fuse retaining contact 23 is broken prior to the final thread being disengaged. This provides protection when removing a fuse from a live circuit by containing any potential momentary arc within the confines of the connector body. Prior to any exposure of metal parts, contact between the end of the fuse and the spring-loaded fuse output contact will be broken as the remaining plastic portion of the fuse retaining cap 7 clears the confines of the connector body. The fuse 27 remains captive within the fuse retaining cap due to the gripping action of the basket area 32 of the cylindrical fuse retaining contact 23 on the end ferrule of the cartridge fuse. Since the line side contact is located deep within the annular section 51 circumjacent the fuse tube 13, access to the live contact is limited by the diametral clearance which is typically less than 0.125". The fuse tube 13 acts as an insulation barrier to prevent the possibility of flashover between the contacts 22 and 26 when the fuse 27 and fuse cap 7 are removed from the device.

The fuse retaining cap 7 is equipped with a tang 8 on the face, to facilitate removal and replacement of the fuse and fuse retaining cap by maintenance personnel wearing protective gear such as linesman gloves and leathers. This feature is of great importance and is nonexistent on present known devices.

With the fuse cap 7 in place in the unit, an O-ring 31 is sandwiched within the confines of an O-ring retaining counterbore 45 and the fuse cap annular rib 46 providing a watertight seal.

With the right-hand side (phase "B") being completed in like fashion, the male plug assembly is then simply inserted into the bipolar receptacle, the boot 44 fitting intimately with the outer circumference of the receptacle housing 25, providing a watertight seal.

In the event of a pole knockdown or other inadvertent action causing undue tension on the load side output wires 42 and 43, the plug and boot assembly 44 will disconnect from the receptacle 24 and housing 25, insuring interruption of power to the load side of the circuit without interruption to the line or feed side.

The boot 44 is designed with two apertures 48 and 49 in the top to receive one wire each. The boot is made of an elastomeric material which is pliable enough to allow the apertures which are sized slightly smaller than the smallest conductor to stretch enough to accommodate wires three or four trade sizes larger.

It is preferable that the unit be factory assembled in the following manner. Referring to the exploded view in FIG. 11, one body half 37 will be nested in a fixture, the tulip connector 22 will be welded to tubular line bus 20 at 35. The fuse output cable 29 is soldered or welded to contact 26, the spring 28 is inserted in the fuse tube 13, and the cable and contact are inserted into the fuse tube, tne cable passing through the spring and out through a small aperture in the bottom of the fuse tube. The fuse tube assembly is then inserted into the tulip contact. This entire assembly is then nested within the body half 37, the extended tap of the tulip contact resting in slot 12, the fuse tube resting in support ribs 14 and positioned rearward against depth stop 15. The fuse output cable is then routed along the recess provided along the top of ribs 14 and out through aperture 34. The opposite body half 19 would then be aligned with the nested assembly and mated, preferably by ultrasonic welding, induction bonding, or a similar process, but could be accomplished with chemical adhesives, mechanical fasteners, or other various fastening means. In the event chemical adhesives were used, it would be preferable to apply adhesive to the fuse tube supporting and sealing ribs 14 and 16 along their inside surfaces.

The aforementioned processes would, with appropriate design, eliminate this extra step. Each section would be assembled in like manner. Then two sections could be mated via the external mounting ribs 2, following this procedure, the receptacle housing 25 would be mounted to the top of the unit with means assuring a hermetic seal around mounting surfaces and related bosses 33 and 9. The free ends of the fuse output cables, now located within the confines of the receptacle housing, would be welded to the receptacle sliding contacts 36, and the receptacle mounted within the receptacle housing. Thus completing the major assembly, the remaining parts could be placed in their intended positions or simply placed in a plastic bag or similar sealable container to be installed during the field installation procedure.

Non-fused neutral connectors could be provided by simply placing a "dummy" fuse in one section of the unit or by a factory assembly, eliminating the fuse tube and related items, welding a cable directly to the line contact bus 20 at location 35 and passing it directly through aperture 34, placing a blank cap in place of the fuse retaining cap 7; the remainder of assembly being the same.

The embodiments of the invention in which an exclusive property are claimed are defined as follows:

1. A waterproof fuse holder with a disconnect including a housing, a fuse holding chamber therein and a fuse holding contact in said chamber, a line bus chamber in said housing, input and output line openings in said housing in communication with said line bus chamber, waterproof seal means in said openings for use in attaching input and output lines to said housing, a line bus in said line bus chamber and means on said line bus for connecting input and output lines to the line bus, means in said housing for connecting said line bus and said fuse holding contact, a receptacle housing mounted on said housing and adapted to receive a removable plug, a receptacle contact in said receptacle housing and a connection between said receptacle contact and said fuse holding chamber.

2. The fuse holder of claim 1 further characterized in that said fuse chamber and line bus chamber are adjacent and parallel.

3. The fuse holder of claim 2 further characterized in that said input and output line openings provide for input and output lines extending generally perpendicular to said line bus chamber and to said fuse holder chamber.

4. The fuse holder of claim 2 further characterized in that said fuse holding chamber and line bus chamber are separated by a wall, and an opening in said wall for connecting said line bus and said fuse holding contact.

5. The fuse holder of claim 4 further characterized in that the connection between said line bus and said fuse holding contact includes a ring member attached to the exterior of said line bus and encircling said fuse holding contact.

6. The fuse holder of claim 1 further characterized in that the connection between said receptacle contact and said fuse holding chamber includes a cable and a spring-biased fuse contact.

7. The fuse holder of claim 1 further characterized in that said waterproof seal means includes a seal member in each opening, and means for compressing said seal members upon an an electrical line positioned therein.

8. The fuse holder of claim 7 further characterized by and including a rotatable connector member at each opening, with the attachment of said connector members compressing said seal members upon an electrical line positioned in an opening.

9. The fuse holder of claim 8 further characterized in that each seal member and that portion of the housing adjacent each opening have cooperating surfaces thereon for use in compressing said seal members upon an electrical line positioned in an opening.

10. The fuse holder of claim 9 further characterized in that said cooperating surfaces are similarly tapered.

11. The fuse holder of claim 1 further characterized by and including a fuse retaining cap attachable to said housing for positioning a fuse within said fuse holding chamber.

12. The fuse holder of claim 11 further characterized in that said fuse holding contact is mounted in said fuse retaining cap for removably holding a fuse therein.

13. The fuse holder of claim 12 further characterized by and including a fuse tube in said fuse holding chamber, a spring-biased fuse contact in said fuse tube, said receptacle contact being connected to said fuse contact.

14. The fuse holder of claim 12 further characterized by and including a seal between said fuse retaining cap and said housing.

15. The fuse holder of claim 1 further characterized in that said line bus is generally cylindrical in form having radially extending openings therein for the insertion of input and output lines, said line bus chamber and said fuse chamber having a wall providing separation therebetween, and an electrical contact attached to said line bus and extending into said fuse chamber.

16. The fuse holder of claim 15 further characterized by and including a wall in said housing separating the receptacle contact and said fuse holding contacts whereby there is physical separation between a fuse in said fuse chamber, said line bus in said line bus chamber, and the receptacle contact in said receptacle housing.

17. The fuse holder of claim 1 further characterized in that said housing includes a pair of fuse chambers, and a pair of line bus chambers, there being both input and output openings for each line bus chamber, and an electrical connection between one of the line bus chambers and one of the fuse chambers, and a second electrical connection between the other line bus chamber and the other fuse chamber, and wherein said receptacle housing has bipolar contacts.

18. The fuse holder of claim 17 further characterized in that all of said line bus chambers and fuse holder chambers are generally parallel and adjacent, there being a fuse retaining cap for each fuse chamber, with each fuse retaining cap having a fuse holding contact which mounts a fuse thereto, whereby removal of said caps removes the fuse from the fuse chambers.

* * * * *